United States Patent [19]

Prestel

[11] Patent Number: 4,587,386

[45] Date of Patent: May 6, 1986

[54] SNAP-ACTING SWITCH

[75] Inventor: Fritz Prestel, Hausen a. Tann, Fed. Rep. of Germany

[73] Assignee: BSG-Schalttechnik GmbH & Co. K.G., Balingen, Fed. Rep. of Germany

[21] Appl. No.: 619,636

[22] Filed: Jun. 11, 1984

[51] Int. Cl.[4] ..... H01H 3/16

[52] U.S. Cl. ..... 200/61.58 R; 200/73; 361/350; 361/397

[58] Field of Search ..... 200/61.58 R, 50 R, 50 A, 200/73, 67 R, 67 B, 292; 361/397, 413, 350, 351

[56] References Cited

U.S. PATENT DOCUMENTS 3,932,716 1/1976 Mottel et al. ..... 200/50 A

FOREIGN PATENT DOCUMENTS 2802133 7/1979 Fed. Rep. of Germany .... 200/67 B

*Primary Examiner*—A. D. Pellinen
*Assistant Examiner*—Morris Ginsburg
*Attorney, Agent, or Firm*—McAulay, Fields, Fisher, Goldstein & Nissen

[57] ABSTRACT

A snap-acting switch comprising a movable contact arm, two holding parts carrying contact pieces which are directly attached on a mounting plate at a specified distance from one another, and an actuating element. The contact arm and the actuating element are mounted on the same holding part, with a first pre-load spring being effective between the contact arm and a second pre-load spring between the holding part and the actuating element. The holding parts are so positioned on the mounting plate, that the actuating element projects beyond a marginal area and covers both sides of the mounting plate in the area so that transversely applied switching forces will operate the actuating element.

7 Claims, 2 Drawing Figures

SNAP-ACTING SWITCH

STATE OF THE ART

The present invention is based on a snap switch. A snap switch of this type is known from German laid open patent application 28 02 133 by the same applicant. In the case of this known snap switch holding parts with stationary contact pieces are directly placed on the surface of a mounting plate, which might be equipped with additional switching elements and which can be a printed board, a printed circuit or the like. The holding parts also serve as bearing means for the contact arm which preferably consists of a resilient, metallic material and rests against a larger holding part when subjected to the pressure of a spring connected to an actuating element which is movable through external action. The motions of the actuating element are transferred via the spring to the contact arm, which can thus be pivoted from a neutral position beyond its dead point into its active switching position to contact one of the holding parts.

In a first embodiment of the known snap switch the actuating element subjected to external action is separately mounted in a pivot pin connection at the mounting plate and is extended with an outer marginal area so far towards the mounting plate side opposite its bearing means that it enables the contact arm motion to be effected there.

In another embodiment of the known snap switch all switching elements are arranged on one side of the mounting plate, and the actuating element is supported at that holding part with the stationary opposite contact piece at which the contact arm pivoted at the other holding part engages in its active switching position.

The known snap switch can be considered as being disadvantageous in that the external action on the actuating element may essentially be applied in that direction only in which the actuating element must then move for effecting the changeover of the contact arm itself, because forces applied in different directions might tilt the actuating element out of its bearing. Moreover the known snap switch does not enable a changeover of the neutral position of the contact arm because the only one preload tension spring provided between the contact arm and the actuating element and the switching mechanism comprising the various lever arrangements and bearing means permit the neutral position to be the stationry initial position, for example in the OFF position of the switch, only if this position coincides with the position beyond the dead point of the contact arm. Two positions beyond the dead point for the respective switching end positions require external actuating motions which are also effective in the opposite direction and are, moreover, not achievable if the external actuating element is designed U-shaped with its bearing at the lower holding part.

The invention is based on the object to modify and improve the known snap switch in such a manner that externally applied actuating forces acting on the actuating element and changing-over the switch can also be applied in directions transverse to the direction of motion of actuating element and contact arm without causing any damage and that in the thus achieved active switching position the contact arm is securely maintained in a position beyond the dead point.

ADVANTAGES OF THE PRESENT INVENTION

The snap switch in accordance with the present invention provides a solution to this problem in that, with the basic switching kinematics being maintained, a changeover switching position can be achieved by means of the additional compression spring arranged between the holding part, which also supports the actuating element, and the contact arm, said spring exerting its force on the contact arm so that it is reliably returned into its initial position under the pressure of this additional spring even if the previously assumed active switching position has been a position beyond the dead point relative to the preload spring between contact arm and actuating element.

A further advantage is that the actuating element is reliably mounted and allows switching actions in particular from a direction vertical to the direction of motion carried out by the movable switching components during the changeover cycle.

It is particularly advantageous to so arrange the snap switch with its actuating element at a cutout of the mounting plate that an outer lever portion sliding in said cutout and effecting the changeover can act upon the rear side of the actuating element. Both the holding part supporting the actuating element and said actuating element itself are provided with similar outer contours so that in the active switching position of the illustrated embodiment the actuating element subjected to the externally applied actuating effect is snugly forced with essentially its entire length against the holding part. This feature also prevents tilting and faulty motions.

DRAWING

An embodiment of the invention is shown in the attached drawing and explained in the following description.

FIG. 1 is a plan view of the snap switch in accordance with the invention on its mounting plate and FIG. 2 a rear view of the snap switch with mounting plate

DESCRIPTION OF THE EMBODIMENTS

Figure 1:
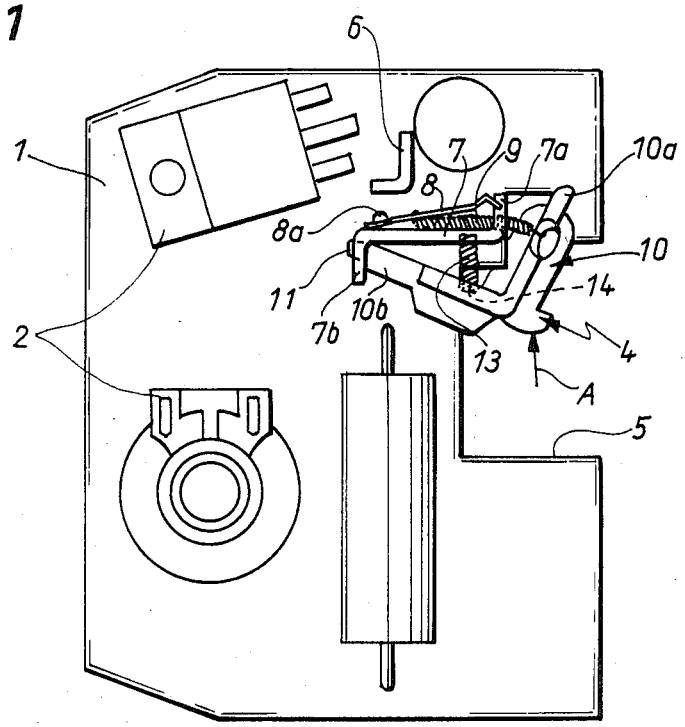
Figure 2:
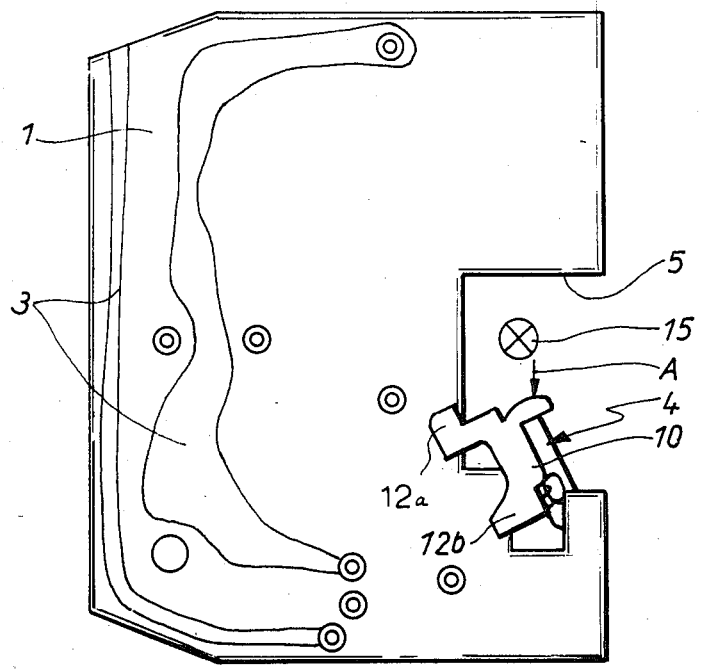

In FIGS. 1 and 2 the mounting plate for the snap switch is assigned reference numeral 1; said plate can be a printed board, a printed circuit or another flat structural component, which can preferably be equipped with additional electric or electronic components at the same time, as are merely indicated for example with reference numeral 2 in FIG. 1; the illustration of FIG. 1 shows the component side of the mounting plate while FIG. 2 shows its rear side with the conductor paths 3, in this case copper-plated.

The embodiment of snap switch 4 in accordance with the invention is arranged on the marginal area of the mounting plate (which carries the component parts of the switch), here in particular adjacent to an approximately rectangularly shaped cutout 5 of the mounting plate and extending partially into said cutout. The construction of the embodiment of the snap switch as shown in FIGS. 1 and 2 comprises essentially the same or identical components as are employed for the initially mentioned known snap switch in accordance with German laid open patent application 28 02 133; i.e. a first holding part 6 and a second holding part 7 are provided, which are arranged at a distance to each other and between which contact arm 8 with its contact piece **8*a* moves for switching. Holding parts or contact pieces 6 and 7 are separately fixed on mounting plate 1; for locating purposes the holding parts are provided with extensions which engage in holes in mounting plate 1 so that the mounting plate can be equipped with the components associated with the snap switch exactly as with other components related to different functions. The holding parts can then be finally secured on the rear side by a corresponding dip-soldering process which simultaneously results in the desired electric connection to the conductor paths 3. The construction of the snap switch in accordance with the invention is therefore principally of the open type, and the mounting plate could simultaneously be considered as being part of a housing for the switch itself. The switch is finally completed by a preload spring 9 and the actuating element 10** subjected to an externally applied actuating motion. In the case of the shown embodiment the shape of the stationary holding parts being directly fixed on the mounting plate has been so selected that each of them features at least one, for example rectangular, bend resulting in two legs each, both of which are preferably located on the mounting plate by means of extensions engaging in corresponding holes thus ensuring a secure anchorage.

The arrangement and the interaction of the individual switching elements of the snap switch in the case of the illustrated embodiment have been so selected that the first stationary holding part 6 is formed by two small legs and is located opposite contact piece 8*a* of the contact arm which in its neutral position rests against the large holding part. The large holding part has approximately the shape of a Z with the upper leg-type bend 7*a* having a central slot not shown in the drawing, through which pre-load spring 9 extends whose one end is attached to the contact arm at a further downward position and whose other end is fastened to the short leg 10*a* of the rectangularly bent actuating element 10. This pre-load spring causes the actuating element to be pulled downwards, i.e. leftwards in the drawing plane on its bearing and connecting area with the other leg 7*b* of the large holding part 7 bent in the opposite direction, whereby the counterforce of the spring which acts upon contact arm 8 forces said contact arm towards its pivoting at the upper bent leg 7*a* of holding part 7. The pivoting of this contact arm 8 which consists of a suitable stiff spring material corresponds to that of the initially mentioned known switch so that it need not be described any further.

The long foot portion 10*b* of the actuating element 10 is mounted at the bottom leg 7*b* of holding part 7 by means of an extension or nose 11 which penetrates a hole or break-through in leg 7*b*. Actuating element 10 is firstly prevented from tilting by flat portions adjacent to nose 11 which are forced against corresponding flat portions of the bent leg 7*b* of holding part 7 by the action of the pre-load spring 9; in accordance with a preferred characteristic of the present invention the actuating element 10 is provided in its upper portin with at least one additional retaining projection or clamping means 12*a*, 12*b*, which as can be seen from FIG. 2 extends to the rear of mounting plate 1, which means that because actuating element 10 is arranged in the marginal area of adjacent to a cutout 5 in mounting plate 1, respectively, said mounting plate 1 can engage a horizontal slot formed as an undercut (not shown) in parts 10*a*, 10*b* of the actuating element which are arranged on the component side and parts or projections 12*a*, 12*b* which are arranged in an overlapping manner on the conductor path side.

In FIG. 1 the contact arm and the actuating element are shown in their neutral position into which the actuating element is pressed via the pre-load spring by means of a second pre-load spring, in this case a compression spring 13, which is arranged between holding part 7 and the inner surface of the adjacent actuating element; for an improved mounting and anchoring of compression spring 13, part of said spring can engage in a corresponding hole 14 in the body of the actuating element. In FIG. 1 the snap switch is shown in the open neutral position where the actuating element is kept at a distance from the large holding part 7 by compression spring 13. Due to the attachment of biasing tension spring 9 at the lower end of switching arm 8 on the one hand and at the short leg 10*a* of the actuating element, the contact arm 8 is maintained pressed against holding part 7 and will be instantaneously reversed to contact the opposite holding part 6 for corresponding contact making if a force is applied to actuating element 10 in the direction of arrow A. The actuating element is then in intimate contact with the complementary contour of the large holding part 7 and shifts the pivot point of the spring at its short leg 10*a* in the plane of the drawing upwards until the contact arm is drawn into its active switching position with spring 9 sliding in the upper short bend 7*a* of holding part 7. If the force in the direction of arrow A is no longer applied actuating element 10 returns into the open position as shown in FIG. 1 thereby causing the contact arm to rest against the large holding part due to the stronger effect of compression spring 13, although the active switching position in the case of the shown embodiment would correspond to a stable position beyond the dead point of the contact arm.

By installing the actuating element in the marginal or cutout area of the mounting plate so that it covers mounting plate 1 on both sides of advantageous embodiment of the present invention is obtained in that the required externally applied action to cause the switching motion can also be transmitted onto the actuating element in such a manner that a lever or another switch actuating component not shown in the drawing is displaced vertically relative to the actuating element as indicated at 15 in FIG. 2 and towards the direction of its actuating motion until it contacts it. The lever can slide in the cutout of the mounting plate and feature a gradually increasing taper, that is defining a gradually rising inclined plane relative to the drawing plane so that as the actuating element moves into the plane of the drawing, its width gradually increases until it displaces element 10 and causes actuation of the switch. This action by the external switching lever results, as can readily be seen, in an additional force component (due to the friction between switching lever and actuating element) acting vertically to the drawing plane and attempting to tilt the actuating element out of its bearing means; this is prevented by the two-sided grip of the actuating element around mounting plate 1.

I claim:

1. A snap switch attached to a mounting slot with a movable contact arm comprising at least one contact piece, at least one stationary opposite contact piece arranged within a moving range of said contact arm, a spring generating a preload and an actuating element subjected to an externally applied switching action, said actuating element causing the contact arm at least indirectly to perform switching motions, holding means directly attached to said mounting plate and carrying the movable piece thereon, characterized in that said actuating element is mounted at that point on the holding means against which said contact arm rests in its neutral position, at least one projection on said actuating element, and clamping means for clamping said actuating element against a rear side of said mounting plate.

2. A snap switch as in claim 1, and a pre-load spring positioned between said holding means and said actuating element to support said contact arm in the neutral position.

3. Snap switch in accordance with claim 1, characterized in that holding means providing the mounting for actuating element is arranged at such a position on said mounting plate that sections of the actuating element are attached to the mounting plate margin so as to clamp both sides and other parts are arranged so as to clear the mounting plate.

4. Snap switch in accordance with claim 2, characterized in that the components of the actuating element arranged clear of the mounting plate and projecting beyond its margin are subjected to the application of the force to the actuating element for changing over.

5. Snap switch in accordance with claim 1, characterized in that the parts of the actuating element which are clear of the mounting plate project into a cutout in mounting plate in such a manner that a switching lever guided in this cutout in a direction vertical to the switching direction of the actuating element for changing over gradually forces said actuating element out of said cutout.

6. Snap switch in accordance with claim 1, characterized in that said holding means providing the mounting for actuating element has the shape of a z with a lower bent leg mounted in the actuating element and an upper leg which is connected with pre-load spring attached to the movable contact arm.

7. Snap switch in accordance with claim 1, characterized in that additional pre-load spring comprises a compression spring and maintains said actuating element in an open position providing a distance to holding part.

* * * * *